US010984970B2

(12) United States Patent
Huang et al.

(10) Patent No.: US 10,984,970 B2
(45) Date of Patent: Apr. 20, 2021

(54) KEYBOARD

(71) Applicant: CHICONY ELECTRONICS CO., LTD., New Taipei (TW)

(72) Inventors: Yao-Lun Huang, New Taipei (TW); Guo-Yu Shi, New Taipei (TW)

(73) Assignee: CHICONY ELECTRONICS CO., LTD., New Taipei (TW)

( * ) Notice: Subject to any disclaimer, the term of this patent is extended or adjusted under 35 U.S.C. 154(b) by 246 days.

(21) Appl. No.: 16/232,572

(22) Filed: Dec. 26, 2018

(65) Prior Publication Data

US 2020/0013567 A1 Jan. 9, 2020

(30) Foreign Application Priority Data

Jul. 4, 2018 (TW) ..... 107123204

(51) Int. Cl.
*H01H 13/83* (2006.01)

(52) U.S. Cl.
CPC ..... *H01H 13/83* (2013.01); *H01H 2219/06* (2013.01); *H01H 2219/062* (2013.01); *H01H 2227/008* (2013.01); *H01H 2231/002* (2013.01)

(58) Field of Classification Search
CPC ..... H01H 13/83; H01H 2219/06; H01H 2219/062; H01H 2227/008; H01H 2231/002; H01H 3/125; H01H 2221/07; H01H 2213/01; H01H 2219/056; H01H 2219/044
USPC ..... 200/5 A
See application file for complete search history.

(56) References Cited

U.S. PATENT DOCUMENTS 8,203,092 B2 * 6/2012 Chen ..... H01H 13/83 200/314
2014/0138228 A1 * 5/2014 Chen ..... H01H 13/83 200/5 A
2014/0166455 A1 * 6/2014 Chen ..... H01H 13/83 200/5 A

* cited by examiner

*Primary Examiner* — Edwin A. Leon
(74) *Attorney, Agent, or Firm* — Muncy, Geissler, Olds & Lowe, P.C.

(57) ABSTRACT

A keyboard includes a base plate, a plurality of key structures, and a light emitting assembly. The base plate includes a body and a plurality of optically transmissive members. The body has a plurality of hollow portions. The optically transmissive members are contained in the hollow portions, respectively. Each of the optically transmissive members has a light guiding portion and a plurality of connecting structures. The key structures correspond to the optically transmissive members, respectively. One of the key structures is connected to the connecting structures of one of the optically transmissive members. The light emitting assembly includes a driver circuit board and a plurality of light emitting units. The light emitting units are located on the driver circuit board. The driver circuit board is located on one of the surfaces of the base plate. The light emitting units are contained in the light guiding portion, respectively.

11 Claims, 7 Drawing Sheets

KEYBOARD

BACKGROUND OF THE INVENTION

1. Field of the Invention

The present invention relates to a keyboard, and more particularly, to an illuminated keyboard.

2. Description of the Related Art

A keyboard is commonly used in conjunction with a computer as one of the essential input devices. Generally, when most computers and peripheral devices used with computers are developed, lighter, thinner, shorter, and more compact designs are often preferred or required. Keyboards have also been occupying less volume over time. Earlier keyboards were relatively large, while slim keyboards are very common today. In addition, currently, an illuminated keyboard is available on the market. Usually, light sources such as light-emitting diode (LED) modules are located inside an illuminated keyboard. Light is transmitted through the periphery of a key or the surface of a key to allow a user to still clearly discern the location of each key in a low ambient light condition or in a dark environment.

In general, an illuminated keyboard comprises a base plate, a thin film circuit board, a plurality of key structures, and a plurality of light emitting elements. The thin film circuit board, the key structures, and the light emitting elements are all located on the base plate. Moreover, the base plate is usually made of metal. A plurality of connecting structures are formed on the base plate by a stamping process and used for being fixed to the connecting members of the key structures, respectively. The base plate made of metal, however, has the disadvantage of being heavy.

Furthermore, the plurality of light emitting elements of a prior art illuminated keyboard correspond to the plurality of key structures, respectively. In other words, each of the light emitting elements is located under each of the key structures. Thus, light emitted from each of the light emitting elements can be projected toward the keycap of the corresponding key structure directly. The light can pass through the optically transmissive portion of the keycap and travel outward to illuminate the keycap. However, the locations of the connecting members of the key structures limit the choice of locations for the light emitting elements such that the light emitting elements cannot be located at the central portions of the key structures. When adopting the above design (the light emitting elements not being located at the central portions), the corresponding keycaps are not evenly illuminated. Therefore, there is room for further improvements in illumination for a prior art illuminated keyboard.

SUMMARY OF THE INVENTION

In order to solve the aforementioned problems, it is the primary object of the present invention to provide a keyboard. Each of the optically transmissive members of the base plate of the keyboard has a light guiding portion. The problem with a prior art keyboard is that the keyboard is not illuminated evenly. This problem is solved by the design of the light guiding portions of the keyboard of the present invention.

In order to achieve the above-mentioned object, the present invention provides a keyboard, which comprises a base plate, a plurality of key structures, and a light emitting assembly. The base plate comprises a body and a plurality of optically transmissive members. The body has a plurality of hollow portions. The optically transmissive members are contained in the hollow portions, respectively. Each of the optically transmissive members has a light guiding portion and a plurality of connecting structures. The key structures correspond to the optically transmissive members, respectively. One of the key structures is connected to the connecting structures of one of the optically transmissive members. The light emitting assembly comprises a driver circuit board and a plurality of light emitting units. The light emitting units are located on the driver circuit board. The driver circuit board is located on one of the surfaces of the base plate. The light emitting units are contained in the light guiding portion, respectively.

According to one embodiment of the present invention, the body is made of metal. The optically transmissive members are made of plastic.

According to one embodiment of the present invention, the light guiding portion is a concave portion and has a plurality of microstructures, and the plurality of microstructures are formed on an inner surface of the light guiding portion.

According to one embodiment of the present invention, the plurality of microstructure is a stepped structure or a carved texture.

According to one embodiment of the present invention, each of the optically transmissive members has a top surface and a bottom surface. The top surface corresponds to one of the key structures. An opening of the light guiding portion is positioned on the bottom surface. The light emitting assembly is located on the bottom surface of the optically transmissive members.

According to one embodiment of the present invention, the keyboard further comprises a reflective layer and a thin film circuit board. The reflective layer is located on a surface of the light emitting assembly which faces away from the base plate. The thin film circuit board is located on a surface of the base plate which faces away from the light emitting assembly.

According to one embodiment of the present invention, each of the plurality of optically transmissive members has a top surface and a bottom surface. The top surface corresponds to one of the key structures. An opening of the light guiding portion is positioned on the top surface. The light emitting assembly is located on the top surface of the optically transmissive members.

According to one embodiment of the present invention, the keyboard further comprises a reflective layer and a thin film circuit board. The reflective layer is located on the bottom surface of the plurality of optically transmissive members. The thin film circuit board is located on a surface of the light emitting assembly, and the surface faces away from the base plate.

According to one embodiment of the present invention, the light guiding portion is disposed between the plurality of connecting structures.

According to one embodiment of the present invention, the base plate further comprises a plurality of reinforcing structures. Each of the reinforcing structures is connected to two of the adjacent plurality of optically transmissive members. The hollow portions have an extending portion, respectively. The reinforcing structures are contained in the plurality of extending portions.

According to one embodiment of the present invention, the optically transmissive members are formed integrally with the reinforcing structures.

As described above, the keyboard of the present invention comprises a base plate, a plurality of key structures, and a light emitting assembly. The base plate comprises a body and a plurality of optically transmissive members. Moreover, the body has a plurality of hollow portions. The optically transmissive members are contained in the hollow portions. The key structures correspond to the optically transmissive members, respectively. Furthermore, each of the optically transmissive members has a light guiding portion. Light emitting units are contained in the light guiding portion, respectively. Light emitted from the light emitting units can pass through the optically transmissive members and the light guiding portions thereof such that the keyboard is illuminated. The key structures correspond to the optically transmissive members, respectively, and the light emitting units are contained in the light guiding portions of the optically transmissive members; this design provides more even illumination of the keyboard compared with prior art illuminated keyboards.

DETAILED DESCRIPTION OF THE PREFERRED EMBODIMENTS

The advantages and innovative features of the invention will become more apparent from the following detailed description when taken in conjunction with the accompanying drawings.

Figure 1:
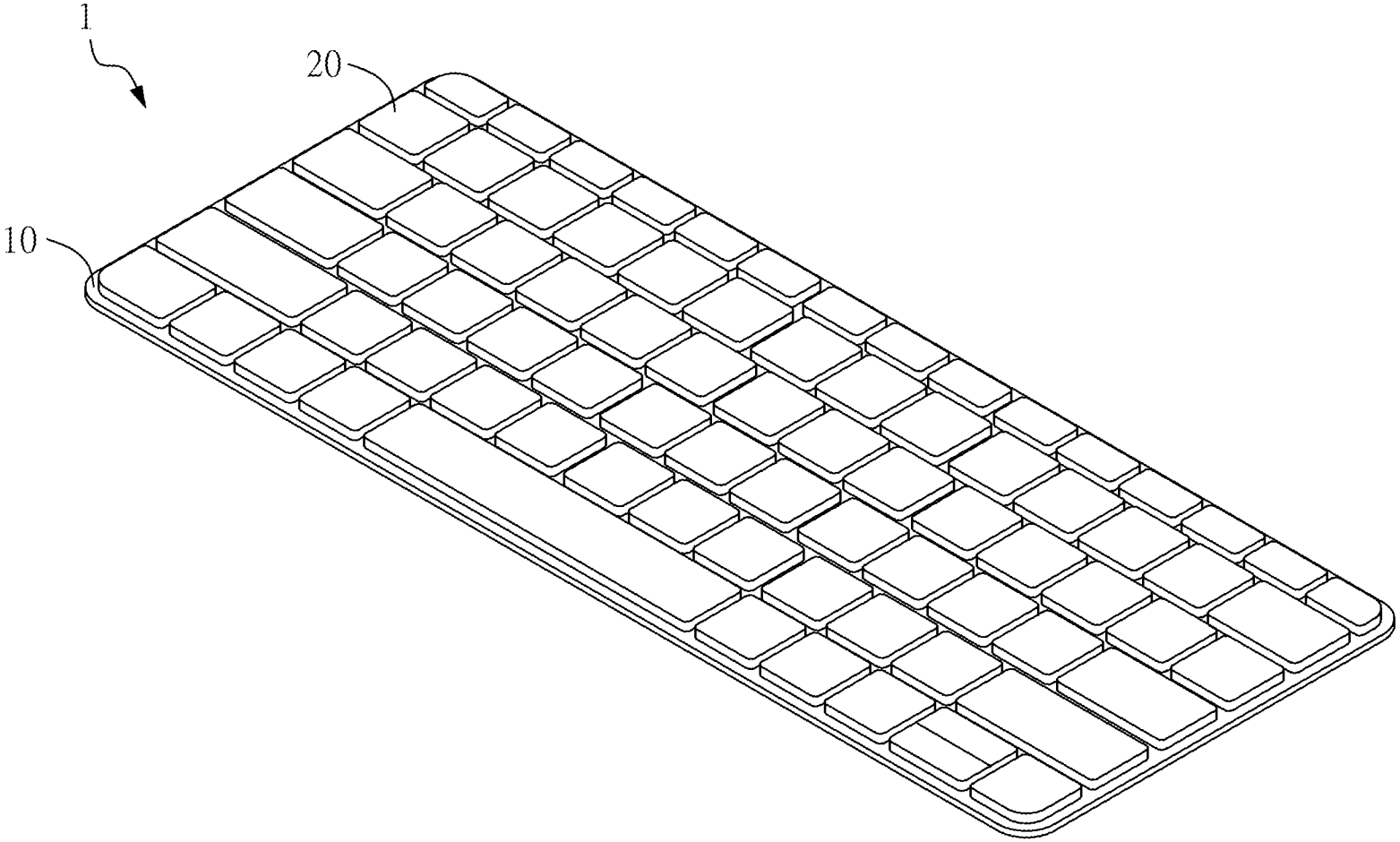
FIG. 1 is a schematic drawing of a keyboard according to one embodiment of the present invention.
Figure 2:
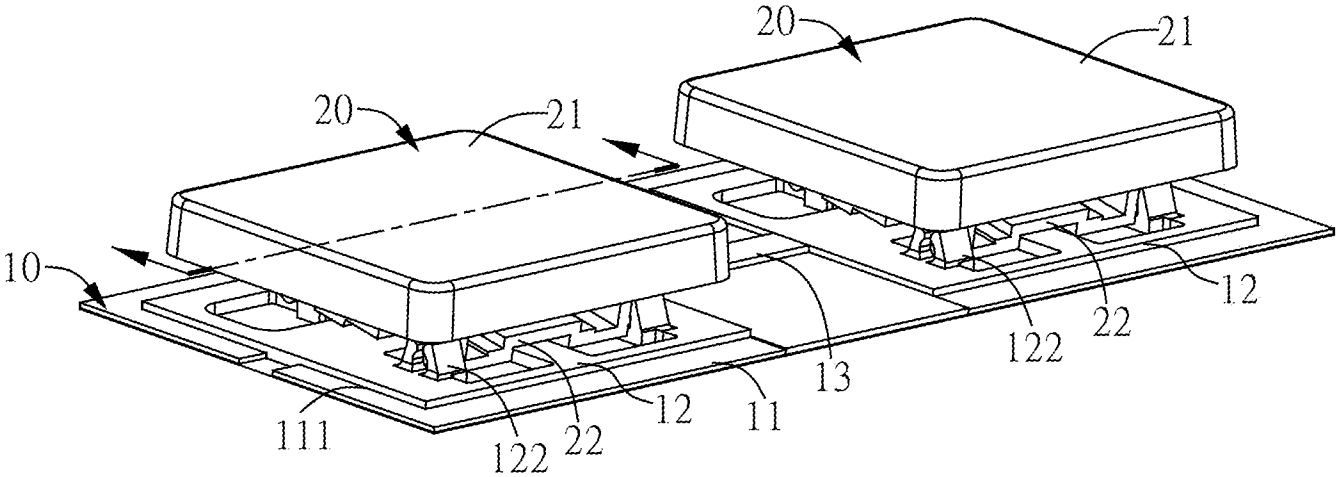
FIG. 2 is a schematic perspective view of two adjacent key structures of the keyboard as shown in FIG. 1.
Figure 3:
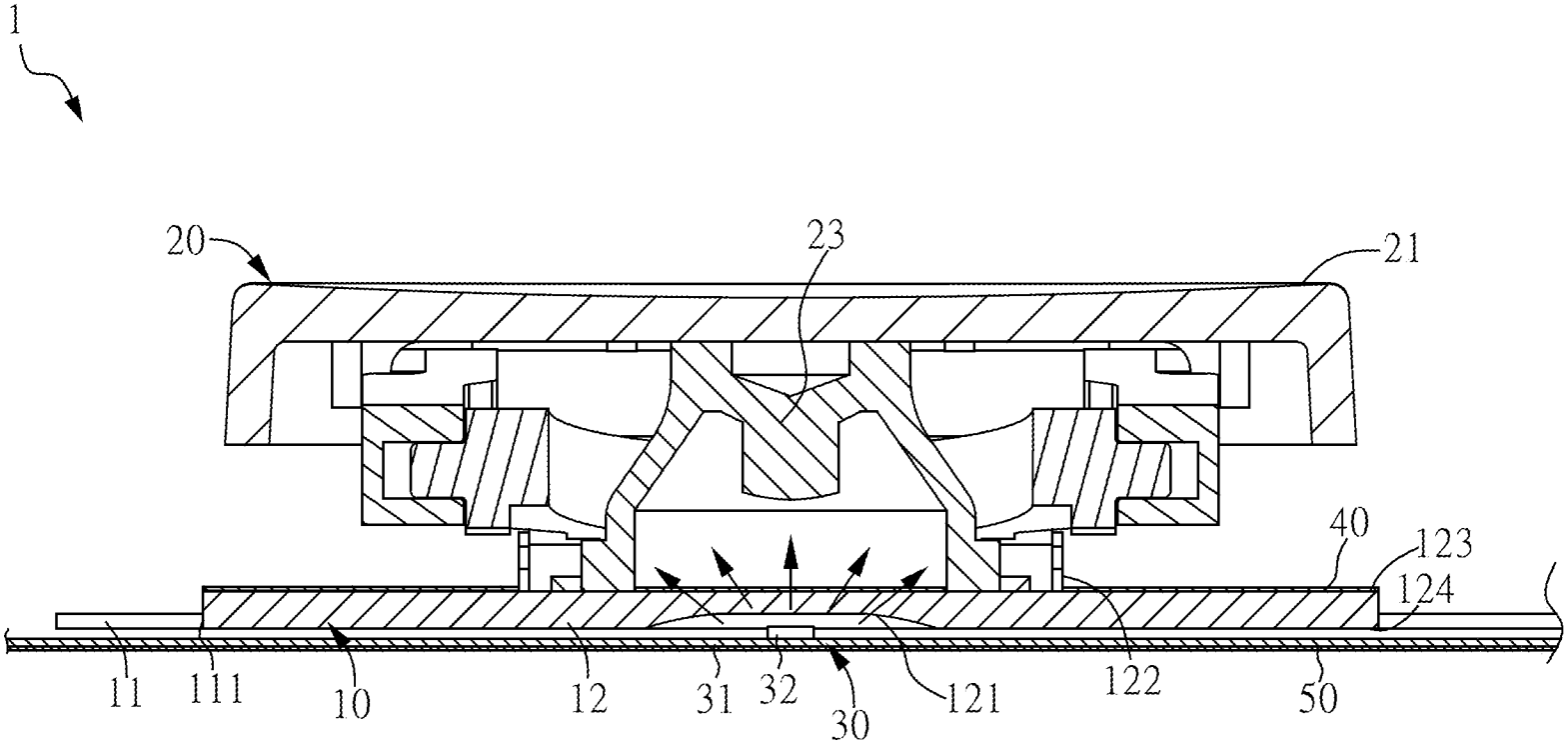
FIG. 3 is a cross-sectional schematic drawing along the line A-A in FIG. 2.
Figure 4:
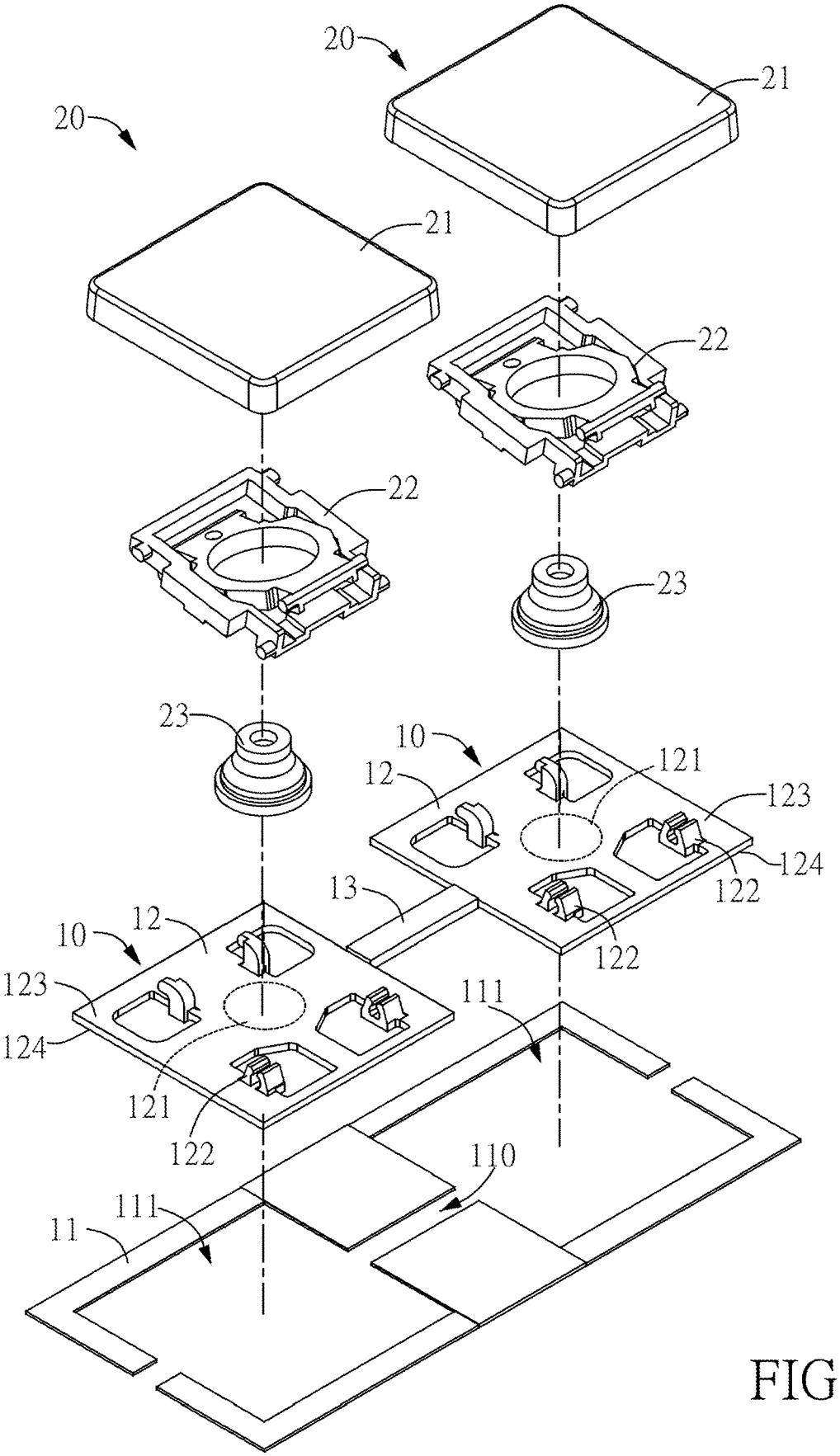
FIG. 4 is a schematic exploded view of a base plate and the key structures as shown in FIG. 2.
Figure 7:
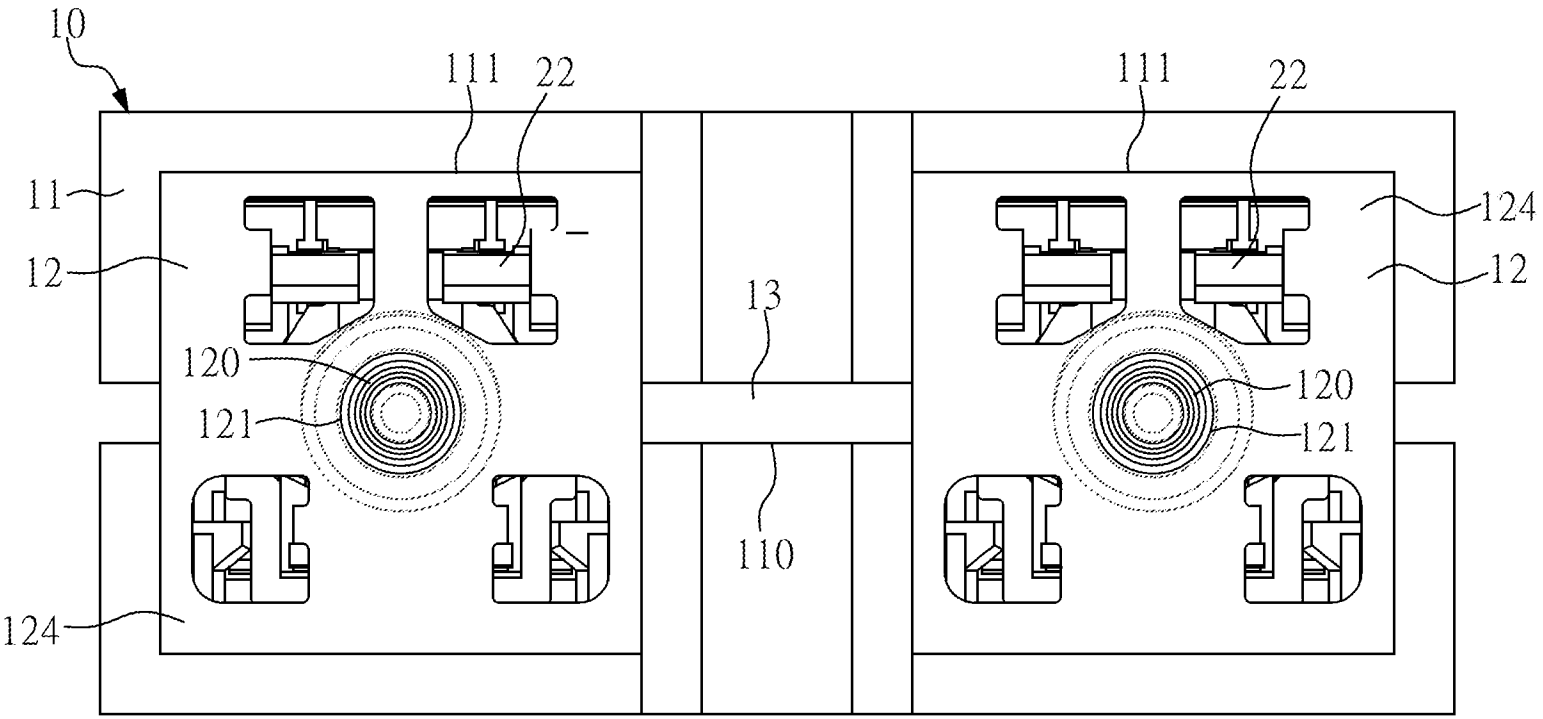
FIG. 7 is a bottom view of the part of the keyboard as shown in FIG. 2.

FIG. 1 is a schematic drawing of a keyboard according to one embodiment of the present invention. FIG. 2 is a schematic perspective view of two adjacent key structures of the keyboard as shown in FIG. 1. FIG. 3 is a cross-sectional schematic drawing along the line A-A in FIG. 2. FIG. 4 is a schematic exploded view of a base plate and the key structures as shown in FIG. 2. Please refer to FIG. 1 to FIG. 4. In this embodiment, a keyboard 1 comprises a base plate 10, a plurality of key structures 20, and a light emitting assembly 30. The base plate 10 comprises a body 11 and a plurality of optically transmissive members 12. Moreover, the body 11 has a plurality of hollow portions 111. The plurality of optically transmissive members 12 are contained in the plurality of hollow portions 111, respectively. The hollow portions 111 are preferably as shown in FIG. 4. It is noted that the hollow portions 111 in FIGS. 2, 3, and 7 are indicated at the boundaries between the body 11 and the optically transmissive members 12. More specifically, in this embodiment, the body 11 is made of metal. In other words, the body 11 is a metal piece, and a plurality of openings are formed in the metal piece as the hollow portions 111. Furthermore, the hollow portions 111 are disposed according to the key structures 20. Preferably, each of the key structures 20 corresponds to each of the hollow portions 111. In this embodiment, the optically transmissive members 12 are made of plastic. The weight of plastic is relatively low. In one embodiment, there are two options for making the body 11 having a plurality of hollow portions 111 and the optically transmissive members 12. In the first option, during the forming process of the body 11, the body 11 having a plurality of hollow portions 111 is first made by a stamping process. Next, the optically transmissive members 12 are formed in the hollow portions 111 by plastic injection molding. In the second option, the body 11 and the optically transmissive members 12 are first made separately. Next, the optically transmissive members 12 are mounted in the hollow portions 111 of the body 11. However, please note that the scope of the present invention is not limited to the above description.

Moreover, each of the plurality of optically transmissive members 12 has a light guiding portion 121 and a plurality of connecting structures 122. More specifically, each of the optically transmissive members 12 has a top surface 123 and a bottom surface 124 which are opposite to each other. In this embodiment, the surface which faces the key structure 20 is referred to as the top surface 123; the surface which faces away from the key structure 20 is referred to as the bottom surface 124. The connecting structures 122 are located on the top surface 123 of the optically transmissive member 12 to correspond to one of the key structures 20 such that one of the key structures 20 can be connected to the connecting structures 122 of the optically transmissive member 12. Specifically, the key structure 20 comprises a keycap 21, a scissor-type connecting member 22, and an elastomer 23. One end of the scissor-type connecting member 22 is connected to the keycap 21, and the other end of the scissor-type connecting member 22 is connected to the connecting structures 122 of the optically transmissive member 12. The connecting structures 122 can be hook structures. Moreover, the connecting structures 122 can be fixed to the scissor-type connecting member 22 of the key structure 20 when the connecting structures 122 and the scissor-type connecting member 22 are snapped together. In the prior art, the connecting structures of a keyboard are formed on the base plate by a stamping process. In this embodiment, the connecting structures 122 can be formed on the optically transmissive members 12 by injection molding. Therefore, only the hollow portions 111 have to be formed in the body 11 made of metal. The connecting structures do not have to be formed on the body 11.

Preferably, characters and symbols on the keycap 21 can be the optically transmissive portion(s) (not shown in figures), and the elastomer 23 is located in a space formed by the keycap 21 and the scissor-type connecting member 22. In this embodiment, the keyboard 1 further comprises a thin film circuit board 40. The thin film circuit board 40 is located on a surface of the base plate 10 which faces the key structure 20. In other words, the thin film circuit board 40 is located on the top surface 123 of the optically transmissive member 12, as shown in FIG. 3. Moreover, the elastomer 23 is located on the thin film circuit board 40, as shown in FIG. 3. When a user presses the keycap 21, the thin film circuit board 40 sends a trigger signal to an electronic device to which the keyboard 1 is connected.

In this embodiment, the light guiding portion 121 is a concave portion structure, preferably an arc-shaped concave portion structure. In this embodiment, the light guiding portion 121 is located on the bottom surface 124 of the optically transmissive member 12 such that the opening of the light guiding portion 121 is positioned on the bottom surface 124. In other words, the optically transmissive member 12 forms a concave portion on the bottom surface 124 acting as the light guiding portion 121 in this embodiment. The hollow portions 111 are disposed according to the key structures 20 such that the key structures 20 also correspond to the optically transmissive members 12, respectively. Moreover, each of the light guiding portions 121 corresponds to each of the key structures 20, respectively. Preferably, the light guiding portion 121 is disposed between the plurality of connecting structures 122 such that the light guiding portion 121 can directly correspond to the keycap 21 of the key structure 20, preferably the central portion of the keycap 21, to provide better illumination of the keyboard 1.

As shown in FIG. 3, in this embodiment, the light emitting assembly 30 comprises a driver circuit board 31 and a plurality of light emitting units 32. The light emitting units 32 are located on the driver circuit board 31. The driver circuit board 31 is located on one of the surfaces of the base plate 10. In this embodiment, the driver circuit board 31 is located on a surface of the base plate 10 which faces away from the key structure 20. In other words, the driver circuit board 31 is positioned on the bottom surface 124 of the optically transmissive member 12. Thus, the light emitting unit 32 can pass through the opening of the light guiding portion 121 positioned on the bottom surface 124 to be contained in the light guiding portion 121. It is noted that the light guiding portion 121 shown in FIG. 3 contains one light emitting unit 32. However, a plurality of light emitting units 32 can be located in the light guiding portion 121, if desired. The present invention is not limited to the number of the light emitting units 32.

The driver circuit board 31 can control the light emission of the light emitting units 32. Light emitted from the light emitting units 32 can pass through the optically transmissive members 12 and the light guiding portions 121 thereof and then pass through the optically transmissive portions of the keycaps 21 (characters and symbols) such that the keyboard 1 is illuminated. Moreover, because of the design of the arc-shaped concave portions of the light guiding portions 121, the light emitted from the light emitting units 32 can correspond to the keycaps 21 centrally to provide better illumination of the keyboard 1. Additionally, the optically transmissive members 12 are made of plastic, which results in a decrease in the weight of the base plate 10.

Figure 5:
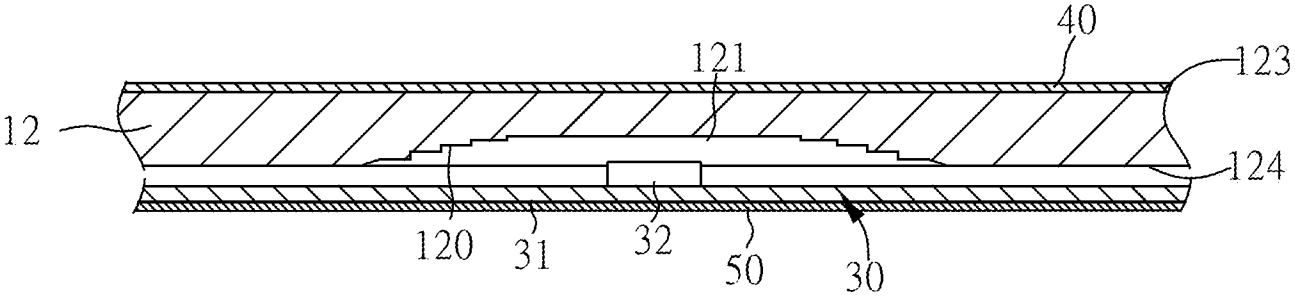
FIG. 5 is an enlarged schematic view of an optically transmissive member, a light emitting assembly, a thin film circuit board, and a reflective layer as shown in FIG. 3.
Figure 6:
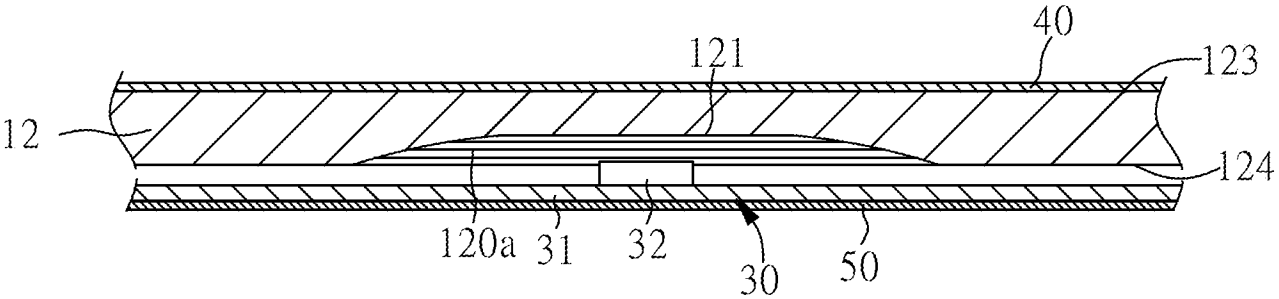
FIG. 6 is a schematic drawing of microstructures as shown in FIG. 5 according to another embodiment.

Please refer to FIG. 5. FIG. 5 is an enlarged schematic view of an optically transmissive member, a light emitting assembly, a thin film circuit board, and a reflective layer as shown in FIG. 3. Preferably, the light guiding portion 121 can have a plurality of microstructures 120. Moreover, the microstructures 120 are formed on an inner surface of the light guiding portion 121. In other words, the microstructures 120 are disposed on the inner surface of the light guiding portion 121. In this embodiment, the microstructures 120 can be a stepped structure such that light emitted from the light emitting unit 32 can produce more even lighting when passing through the light guiding portion 121 and then traveling to the keycap 21. Please refer to FIG. 6. FIG. 6 is a schematic drawing of the microstructures as shown in FIG. 5 according to another embodiment. In another embodiment, the microstructures 120*a* can also be structures of a carved texture. In other words, a carved texture can be formed on the inner surface of the light guiding portion 121 and act as microstructures 120*a* which help guide light. Preferably, in this embodiment, the light guiding portion 121 can be an arc-shaped concave portion. Moreover, the microstructures 120 (or the microstructures 120*a*) can be arranged in concentric circles on the inner surface of the light guiding portion 121, as shown in FIG. 7. FIG. 7 is a bottom view of the part of the keyboard as shown in FIG. 2, that is, a view from the bottom of the bottom surfaces 124 of the optically transmissive members 12 looking toward the keycaps 21.

Please refer to FIG. 3 and FIG. 5. In this embodiment, the light emitting assembly 30 is located on the bottom surface 124 of the optically transmissive members 12. The thin film circuit board 40 is located on a surface of the base plate 10 which faces away from the light emitting assembly 30, that is, on the top surface 123 of the optically transmissive member 12. Preferably, the keyboard 1 further comprises a reflective layer 50. The reflective layer 50 is located on a surface of the light emitting assembly 30 which faces away from the base plate 10. In other words, the reflective layer 50 is located on the bottom surface of the driver circuit board 31; that is, the bottom surface of the driver circuit board 31 can be coated with the reflective layer 50. When light emitted from the light emitting unit 32 travels toward the bottom of the keyboard 1, it will be reflected from the reflective layer 50 and travel to the light guiding portion 121 of the optically transmissive member 12, thereby preventing light from leaking out from the bottom of the keyboard 1.

Figure 8:
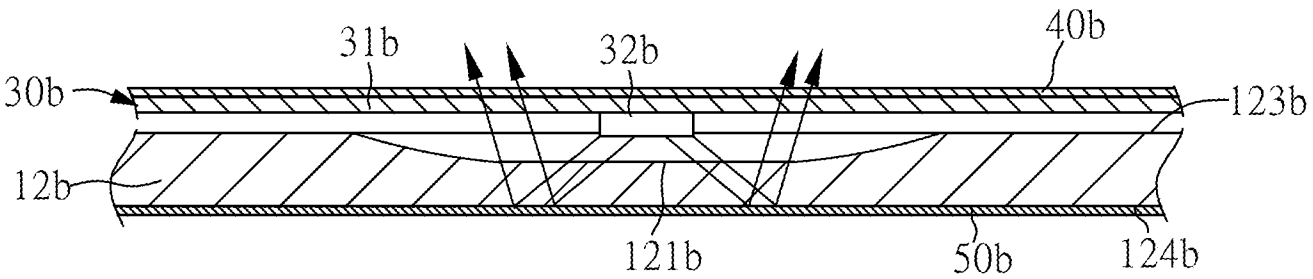
FIG. 8 is an enlarged schematic view of a light guiding portion, the light emitting assembly, the thin film circuit board, and the reflective layer according to another embodiment of the present invention.

FIG. 8 is an enlarged schematic view of a light guiding portion, the light emitting assembly, the thin film circuit board, and the reflective layer according to another embodiment of the present invention. Please refer to FIG. 8. In this embodiment, a light guiding portion 121*b* of an optically transmissive member 12*b* can also be located on a top surface 123*b* of the optically transmissive member 12*b*. In other words, the opening of the light guiding portion 121*b* is positioned on the top surface 123*b*. A light emitting assembly 30*b* also is located on the top surface 123*b* of the optically transmissive member 12*b*, correspondingly. More specifically, a driver circuit board 31*b* is positioned on the top surface 123*b* of the optically transmissive member 12*b*, and a light emitting unit 32*b* is contained in the light guiding portion 121*b*. In this embodiment, a reflective layer 50*b* is located on a bottom surface 124*b* of the optically transmissive member 12*b*. Light emitted from the light emitting unit 32*b* and reflected from the reflective layer 50*b* can pass through the light guiding portion 121*b* and travel to a keycap (Please refer to the keycap 21 in FIG. 3.). Then the light passes through the optically transmissive portion of the keycap to illuminate the keyboard 1.

Please refer to FIG. 4 and FIG. 7. Preferably, in this embodiment, the base plate 10 further comprises a plurality of reinforcing structures 13. Each of the plurality of reinforcing structures 13 is connected to two adjacent optically transmissive members 12. In other words, two adjacent optically transmissive members 12 are connected to each other by each of the plurality of reinforcing structures 13. Correspondingly, the hollow portions 111 of the body 11 also have an extending portion 110 (indicated at the boundary in FIG. 7), respectively. In other words, each of the extending portions 110 is also a hollow structure, which is the extension of the hollow portions 111. Thus, the reinforcing structures 13 can be contained in the extending portions 110. Preferably, the plurality of optically transmissive members 12 are formed integrally with the plurality of reinforcing structures 13. In other words, the optically transmissive members 12 are formed simultaneously with the reinforcing structures 13 by plastic injection molding. The optically transmissive members 12 are contained in the hollow portions 111, and the reinforcing structures 13 are contained in the extending portions 110. The disposition of the reinforcing structures 13 makes a tighter connection between the optically transmissive members 12 and the body 11.

As described above, the keyboard of the present invention comprises a base plate, a plurality of key structures, and a light emitting assembly. The base plate comprises a body and a plurality of optically transmissive members. Moreover, the body has a plurality of hollow portions. The optically transmissive members are contained in the hollow portions. The key structures correspond to the optically transmissive members, respectively. Furthermore, each of the optically transmissive members has a light guiding portion. Light emitting units are contained in the light guiding portion, respectively. Light emitted from the light emitting units can pass through the optically transmissive members and the light guiding portions thereof such that the keyboard is illuminated. The key structures correspond to the optically transmissive members, respectively, and the light emitting units are contained in the light guiding portions of the optically transmissive members; this design provides more even illumination of the keyboard compared with prior art illuminated keyboards.

In addition, the optically transmissive members and the body are components made of different materials, and the optically transmissive members are made of plastic, which results in a decrease in the weight of the base plate and the overall weight of the keyboard.

It is noted that the above-mentioned embodiments are only for illustration. It is intended that the present invention cover modifications and variations of this invention provided they fall within the scope of the following claims and their equivalents. Therefore, it will be apparent to those skilled in the art that various modifications and variations can be made to the structure of the present invention without departing from the scope or spirit of the invention.

What is claimed is:

1. A keyboard comprising:

a base plate comprising:

a body having a plurality of hollow portions; and a plurality of optically transmissive members contained in the plurality of hollow portions, respectively, each of the plurality of optically transmissive members having a light guiding portion and a plurality of connecting structures;

a plurality of key structures corresponding to the plurality of optically transmissive members, respectively, each of the plurality of key structures comprising:

a keycap;

a connecting member, one end of which connected to the keycap, and the other end of which connected to the plurality of connecting structures of one of the plurality of optically transmissive members; and an elastomer located in a space formed by the keycap and the connecting member; and a light emitting assembly comprising a driver circuit board and a plurality of light emitting units, the plurality of light emitting units being located on the driver circuit board, the driver circuit board being located on one of the surfaces of the base plate, and the plurality of light emitting units being contained in the light guiding portion, respectively.

2. The keyboard as claimed in claim 1, wherein the body is made of metal, and the plurality of optically transmissive members are made of plastic.

3. The keyboard as claimed in claim 2, wherein the light guiding portion is a concave portion and has a plurality of microstructures, and the plurality of microstructures are formed on an inner surface of the light guiding portion.

4. The keyboard as claimed in claim 3, wherein the microstructure is a stepped structure or a carved texture.

5. The keyboard as claimed in claim 3, wherein each of the plurality of optically transmissive members has a top surface and a bottom surface, wherein the top surface corresponds to one of the plurality of key structures, an opening of the light guiding portion is positioned on the bottom surface, and the light emitting assembly is located on the bottom surface of the plurality of optically transmissive members.

6. The keyboard as claimed in claim 5 further comprising:

a reflective layer located on a surface of the light emitting assembly which faces away from the base plate; and a thin film circuit board located on a surface of the base plate which faces away from the light emitting assembly.

7. The keyboard as claimed in claim 3, wherein each of the plurality of optically transmissive members has a top surface and a bottom surface, wherein the top surface corresponds to one of the plurality of key structures, an opening of the light guiding portion is positioned on the top surface, and the light emitting assembly is located on the top surface of the plurality of optically transmissive members.

8. The keyboard as claimed in claim 7 further comprising:

a reflective layer located on the bottom surface of the plurality of optically transmissive members; and a thin film circuit board located on a surface of the light emitting assembly which faces away from the base plate.

9. The keyboard as claimed in claim 2, wherein the light guiding portion is disposed between the plurality of connecting structures.

10. The keyboard as claimed in claim 2, wherein the base plate further comprises a plurality of reinforcing structures, wherein each of the plurality of reinforcing structures is connected to two of the adjacent plurality of optically transmissive members, the plurality of hollow portions have an extending portion, respectively, and the plurality of reinforcing structures are contained in the plurality of extending portions.

11. The keyboard as claimed in claim 10, wherein the plurality of optically transmissive members are formed integrally with the plurality of reinforcing structures.

* * * * *